US011369818B2

(12) United States Patent
Prahl et al.

(10) Patent No.: US 11,369,818 B2
(45) Date of Patent: Jun. 28, 2022

(54) MONITOR COVER AND LIGHTING APPARATUS AND METHOD

(71) Applicant: ELKHART BRASS MANUFACTURING COMPANY, LLC, Elkhart, IN (US)

(72) Inventors: Kevin Prahl, Elkhart, IN (US); Garry Lund, Edwardsburg, MI (US); Kyle Stoops, Goshen, IN (US); Eric Combs, Shoreham, NY (US); Keith Chard, Elkhart, IN (US)

(73) Assignee: ELKHART BRASS MANUFACTURING COMPANY, LLC, Elkhart, IN (US)

( * ) Notice: Subject to any disclaimer, the term of this patent is extended or adjusted under 35 U.S.C. 154(b) by 53 days.

(21) Appl. No.: 16/842,266

(22) Filed: Apr. 7, 2020

(65) Prior Publication Data

US 2021/0308510 A1 Oct. 7, 2021

(51) Int. Cl.

| | |
|---|---|
| ***A62C 31/28*** | (2006.01) |
| ***A62C 35/58*** | (2006.01) |
| ***F21V 3/00*** | (2015.01) |
| *F21Y 105/16* | (2016.01) |
| *F21Y 115/10* | (2016.01) |

(52) U.S. Cl.
CPC ..... *A62C 31/28* (2013.01); *A62C 35/58* (2013.01); *F21V 3/00* (2013.01); *F21Y 2105/16* (2016.08); *F21Y 2115/10* (2016.08)

(58) Field of Classification Search
None
See application file for complete search history.

(56) References Cited

U.S. PATENT DOCUMENTS

| | | | | |
|---|---|---|---|---|
| 2005/0139143 | A1* | 6/2005 | Dinh | G01D 7/002 116/284 |
| 2009/0101368 | A1* | 4/2009 | Lozier | B05B 15/652 169/56 |
| 2014/0118998 | A1* | 5/2014 | Mabry | F21L 4/02 362/184 |
| 2019/0262642 | A1* | 8/2019 | Petit | A62C 31/28 |
| 2020/0314623 | A1* | 10/2020 | Pellegrini | G06F 16/29 |
| 2021/0088833 | A1* | 3/2021 | Kwon | G02F 1/133607 |

* cited by examiner

*Primary Examiner* — Fatima N Farokhrooz
(74) *Attorney, Agent, or Firm* — Taft Stettinius & Hollister LLP; Derek B. Lavender

(57) ABSTRACT

A device including a monitor assembly having an outlet configured to selectively distribute a fire suppressant there from, the outlet being pivotal about a first axis and a second axis, a cover coupled to the monitor assembly, and a light assembly coupled to the cover. The light assembly illuminates indicia on a lens of the light assembly.

20 Claims, 10 Drawing Sheets

MONITOR COVER AND LIGHTING APPARATUS AND METHOD

FIELD OF THE DISCLOSURE

The present disclosure relates generally to a cover assembly for a monitor on a firefighting device, and more particular to a cover assembly having at least one light module thereon.

BACKGROUND

Monitor assemblies are frequently used on a firefighting, mining, construction, or the like device to direct the distribution of fluid from a source. The monitor assembly is frequently mounted on a truck or other vehicle that has a pump capable of directing fluid through the monitor and out a nozzle with sufficient flow and pressure to reach a remote location. The monitor assembly is often movable along one or more axis to allow the fluid discharged therefrom to be directed by a user. As one of the primary locations that the device discharges fluid, the monitor assembly is often a focal point of the device.

SUMMARY

One embodiment is a firefighting device that has a monitor assembly having an outlet configured to selectively distribute a fire suppressant there from, the outlet being pivotal about a first axis and a second axis, a cover coupled to the monitor assembly, and a light assembly coupled to the cover. Wherein, the light assembly illuminates indicia on a lens of the light assembly.

In one example of this embodiment, the light assembly has a primary module coupled to the cover at a first location and a secondary module coupled to the cover at a second location, the second location being spaced from the first location. In one aspect of this example, the primary module controls the illumination properties of the secondary module.

In another example the light assembly illuminates the indicia in one of a plurality of user-selectable color or illumination pattern. In another example the lens has a coating thereon and the indicia is formed on areas of the lens wherein the coating is removed. In one aspect of this example the lens assembly includes a diffuser positioned between the lens and a light source to evenly spread the light from the light source to the lens.

In yet another example, the indicia is an identifier of a fire station. In another example the cover is formed of a first section and a second section coupled to the monitor. In one aspect of this example, the light assembly has a secondary module coupled to both the first section and the second section.

In another example of this embodiment, the cover assembly rotates with the monitor assembly about the first axis. In one aspect of this example, the cover defines an opening wherein the outlet is pivotal about the second axis in a range defined by the monitor assembly without substantially contacting the cover.

In yet another example, the light assembly is controllable through a Controller Area Network of the firefighting device. In another aspect of this example, the light assembly selectably indicates diagnostics of the firefighting device.

Another embodiment is a cover for a monitor of a firefighting device. The cover includes a cover assembly removably coupled to the monitor, a light assembly coupled to the cover assembly, the light assembly having a housing, a light source, a lens with indicia, and a bezel. Wherein, the bezel and lens are removable from the housing while the housing remains coupled to the cover assembly.

In one example of this embodiment, the lens has a coating thereon that substantially restricts light from passing thereby and the indicia is defined on the lens at portions where the coating is removed. In another example, the light assembly has a plurality of illumination properties that are selectably controlled by a control system of the firefighting device. In one aspect of this example, the illumination properties are selectable by a user interface. As part of this aspect, the illumination properties include one or more of light intensity, light color, and lighting pattern produced by the light assembly.

Another embodiment is a method for displaying indicia on a cover of a monitor. The method includes coupling a housing of a light assembly to the cover, the housing containing a light array, etching indicia into a coating from a lens to allow light produced by the light array to display the indicia, aligning the lens with the housing, and coupling a bezel to the cover to position the lens at least partially between the bezel and the housing. One example of this embodiment includes positioning a diffuser between the light array and the lens.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

Figure 1:
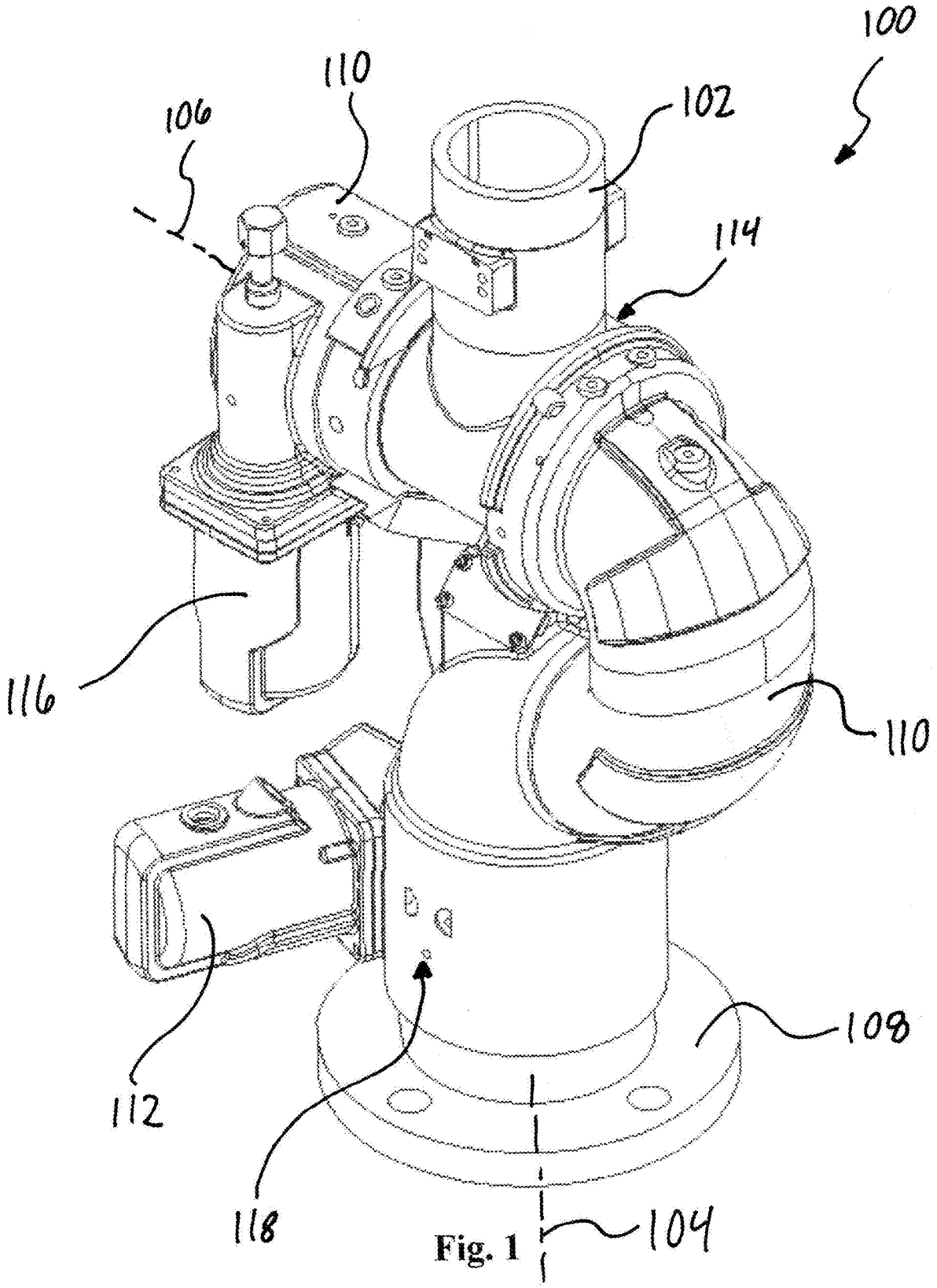
FIG. 1 is an elevated perspective view of a monitor assembly.

For the purposes of promoting an understanding of the principles of the present disclosure, reference will now be made to the embodiments described herein and illustrated in the drawings and specific language will be used to describe the same. It will nevertheless be understood that no limitation of the scope of the present disclosure is thereby intended, such alterations and further modifications in the illustrated devices and methods, and such further applications of the principles of the present disclosure as illustrated therein being contemplated as would normally occur to one skilled in the art to which the present disclosure relates.

The present disclosure relates to a monitor assembly 100 for a firefighting device. The monitor assembly 100 is typically fluidly coupled to a fluid source such as a pump and configured to discharge a firefighting fluid through an outlet 102 and a nozzle. The monitor assembly 100 is often movable to direct the outlet 102 and nozzle towards a fire to discharge firefighting fluid thereto to extinguish the fire. The firefighting fluid may be water, foam, or any other composition capable of extinguishing a fire. While one particular example of a monitor assembly 100 is illustrated, the teachings discussed herein are intended to apply to different monitor assembly designs as well. For example, additional non-exclusive examples of firefighting monitors assemblies described in U.S. Pat. Nos. 9,557,199 and 9,186,531 assigned to ELKHART BRASS MANUFACTURING COMPANY, INC., the contents of which are hereby incorporated herein in their entirety.

While a firefighting device is discussed with detail herein, the present teachings may be applied to any device that utilizes a monitor to direct and discharge a fluid. Accordingly, the teachings of this disclosure may also be applied to mining devices, construction devices, and any other type of device or vehicle that discharges a fluid.

The monitor assembly 100 may be pivotable about a first axis 104 and a second axis 106. More specifically, the monitor assembly 100 may have a base section 108 that is coupled to the firefighting device or any other structural member capable of supporting the monitor assembly 100. The base section 108 may be fixedly coupled to the firefighting device so the base section 108 does not substantially move relative to the portion of the firefighting device it is coupled to. Pivotally coupled to the base section 108 may be an intermediate section 110. The intermediate section 110 may be pivotally coupled to the base section 108 so the intermediate section 110 can pivot about the first axis 104 relative to the base section 108. Further still, a first motor assembly 112 may selectively rotate the intermediate section 110 relative to the base section 108.

The monitor assembly 100 may also have an outlet section 114 pivotally coupled to the intermediate section 110. The outlet 102 may extend from the outlet section 114 and the outlet section 114 may be pivotal along the second axis 106. A second motor assembly 116 may selectively pivot the outlet 102 about the second axis 106 relative to the intermediate section 110.

In one aspect of this disclosure, the second axis 106 may be reoriented about the first axis 104 as the intermediate section 110 is pivoted about the first axis. In this configuration, the outlet 102 can be repositioned about the first axis 104 and the second axis 106 to provide precise control over the direction the firefighting fluid is discharged from the monitor assembly 100. Further, the first and second motor assemblies 112, 116 may be selectively controlled to allow a user to re-orient the monitor assembly 100 to ensure firefighting fluidly is effectively discharged towards a fire. While a particular monitor assembly 100 is illustrated and discussed herein, this disclosure is equally applicable to other monitor assemblies as well. Accordingly the monitor assembly 100 shown and described herein is only one example, and the teachings of this disclosure are intended to be applied to any type of monitor assembly.

Figure 2A:
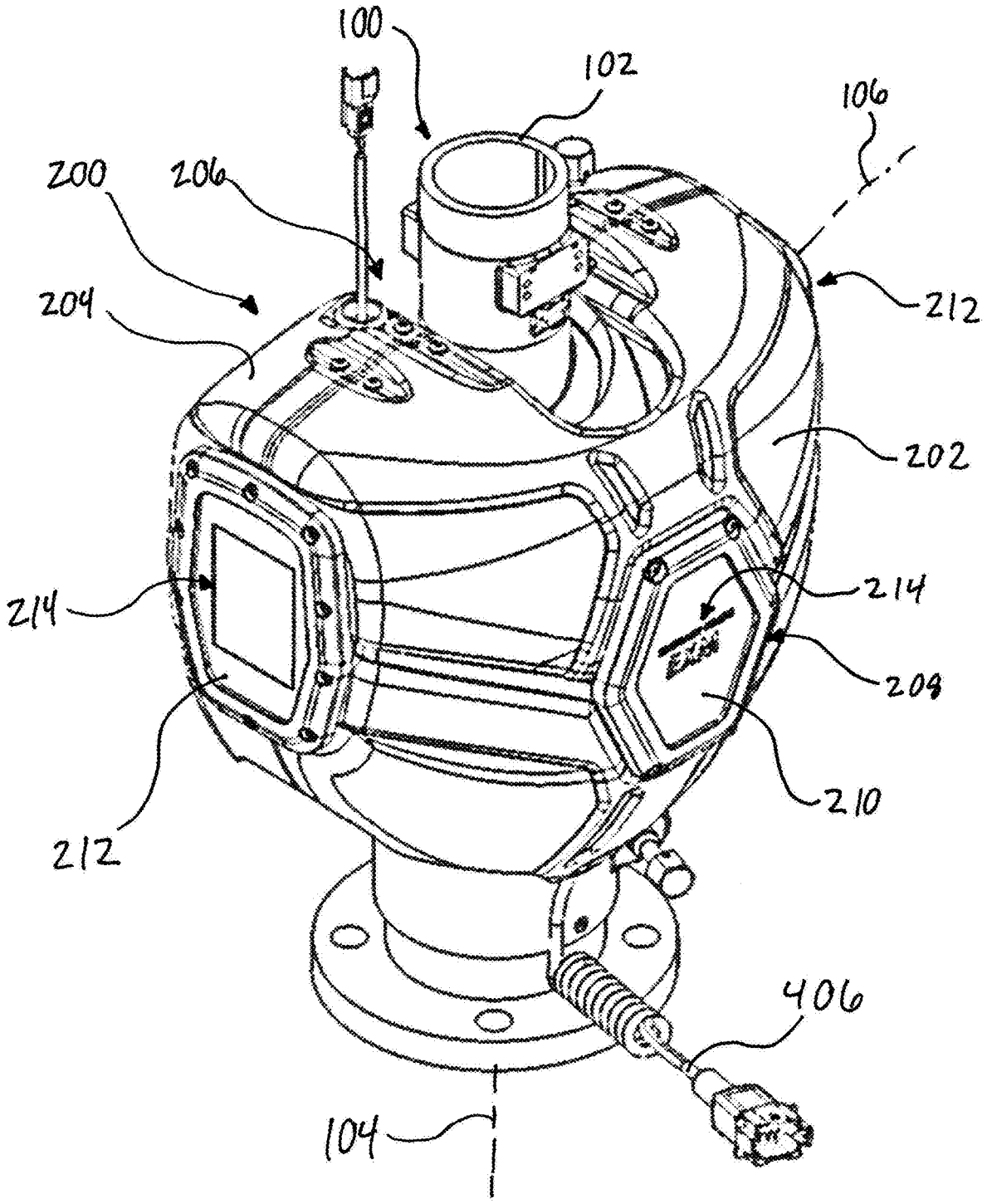
FIG. 2*a* is an elevated perspective back view of the monitor assembly of FIG. 1 with a cover assembly coupled thereto.
Figure 2B:
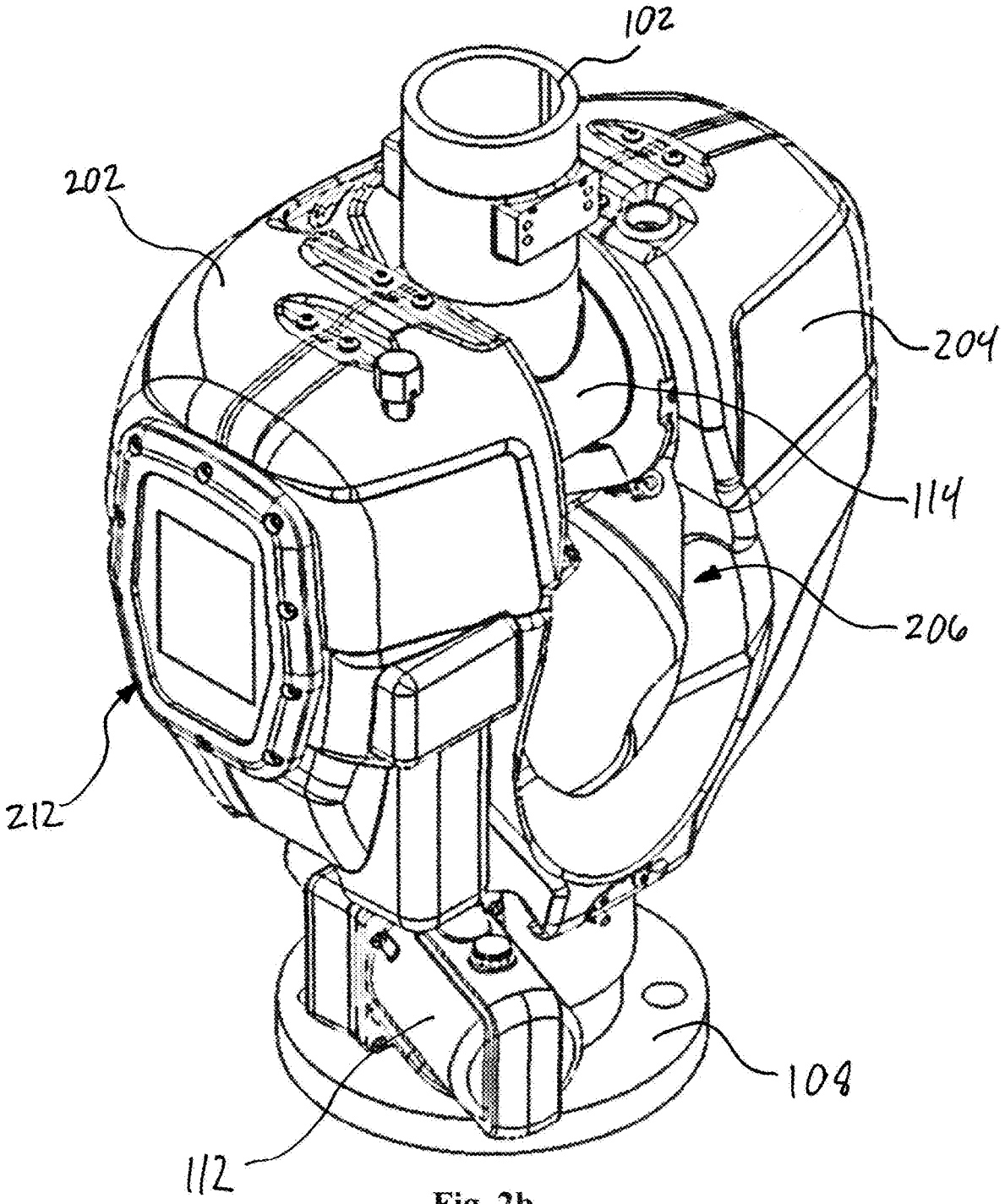
FIG. 2*b* is an elevated perspective front view of the monitor assembly of FIG. 2*a;*

Referring now to FIG. 2, a cover assembly 200 is illustrated coupled to the monitor assembly 100. The cover assembly 200 may have a first section 202 and a second section 204 coupled to the monitor assembly 100. In one aspect of this disclosure, the cover assembly 200 may be coupled to the intermediate section 110 of the monitor assembly 100 to pivot about the first axis 104 therewith. Further, the cover assembly 200 may define an opening 206 therethrough. The opening 206 may be sized to allow the outlet 102 to pivot about the second axis 106 without substantially contacting the cover assembly 200. In other words, as the monitor assembly 100 pivots about the first axis 104 the cover assembly 200 rotates therewith. However, as the outlet section 114 pivots about the second axis 106, the outlet 102 moves relative to the cover assembly 200 within the opening 206 and does not substantially contact the cover assembly 200.

Each section 202, 204 of the cover assembly 200 may be formed of a plastic, metal, composite, or the like material. In one non-exclusive example, each section 202, 204 is made of ABS plastic and formed using a vacuum forming process. Each section 202, 204 is shaped to correspond with one another to substantially cover the monitor assembly 100 less the opening 206. Further, the sections 202, 204 are sized to provide appropriate clearances with the monitor assembly 100 to allow the monitor assembly 100 to move about the axes 104, 106 to the same degree as if no cover assembly 200 were present at all. That is to say, the cover assembly 200 does not restrict the available movement of the monitor assembly 100.

In another aspect of this disclosure, the cover assembly 200 may have one or more light assembly 208 coupled thereto. In one non-exclusive example, the light assembly 208 may include a primary module 210 at a first location and at least one secondary module 212 at a second position. Further still, in one non-exclusive example there may be two secondary modules 212 coupled to the cover assembly 200. However, fewer or more secondary modules are considered herein for the light assembly, and the particular number of secondary modules is only meant as one example of the present disclosure and in one embodiment there may not be any secondary modules.

The light assembly 208 may contain indicia 214 on one or more of the modules 210, 212. The indicia 214 may be formed on the lens of the corresponding module 210, 212 and illustrate a logo or text when the module 210, 212 is illuminated or otherwise. In one non-exclusive example, the indicia 214 may indicate the fire station from which the firefighting device came. Alternatively, the indicia may indicate information about the firefighters manning the firefighting device. Accordingly, the present disclosure contemplates selecting any type of indicia for the modules 210, 212 and the particular indicia discussed is exemplary.

Figure 3:
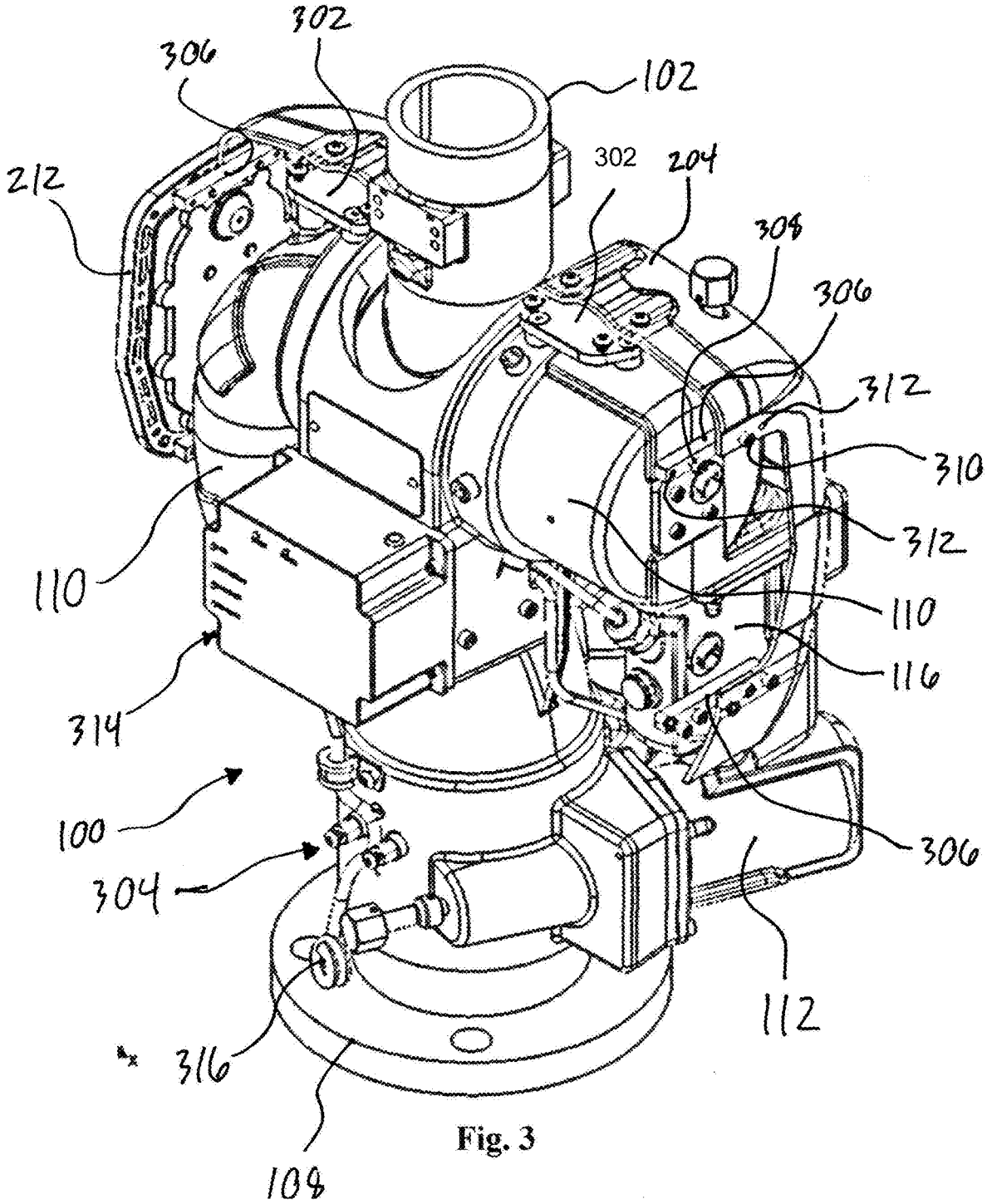
FIG. 3 is an elevated perspective view of FIG. 2*a* with a section of the cover assembly removed.

Referring now to FIG. 3, the monitor assembly 100 is illustrated with the first section 202 removed. In this configuration, mounting plate or plates 302 are illustrated providing a coupling location for the cover assembly 200. More specifically, the mounting plates 302 may be coupled to the intermediate section 110 via standoffs or the like to provide a coupling location for the first and second section 202, 204 of the cover assembly 200. Alternatively, the mounting plates 302 may be coupled directly to the intermediate section 110 and not use standoffs at all. A mounting plate 302 may be positioned on either side of the outlet 102. Further, each mounting plate 302 may provide a coupling location for both the first section 202 and the second section 204. Further still, in one aspect of this disclosure each mounting plate 302 may provide at least two coupling locations for each section 202, 204 to ensure that the sections 202, 204 remain properly aligned when coupled to the mounting plate 302.

In one non-exclusive example, the mounting plates 302 may provide threaded holes configured to receive fasteners such as screws therein. The fasteners may be threadably received by the mounting plates 302 to couple the corresponding sections 202, 204 thereto. However, any other known coupling mechanism is also considered herein, and the sections 202, 204 can be coupled to the intermediate section 110 using any coupling method or fastener known in the art.

The intermediate section 110 may also define a first section lower mount 304 therein where the first section 202 can be coupled to the intermediate section 110 at a location proximate to the base section 108. The lower mount 304 may provide a threaded receiver to allow a threaded fastener to couple the first section 202 to the intermediate section 110 at a location spaced from the mounting plates 302. By spacing the lower mount 304 from the mounting plates 302, the first section 202 may be coupled to the intermediate section 110 to be substantially stable and immovable relative thereto. Similarly, a second section lower mount 118 (see FIG. 1) is positioned on the opposite side of the intermediate section 110 to similarly correspond with the second section 204. While threaded mounting receivers are described herein, any other known coupling mechanism is also considered and the sections 202, 204 can be coupled to the intermediate section 110 at the lower mounts 304, 118 using any coupling method or fastener known in the art.

In the illustrative view of FIG. 3, one of the secondary modules 212 has been removed from the cover assembly 200 to illustrate module couplers 306. The module couplers 306 may be coupling members that are positioned along an inner surface of the respective cover assembly sections 202, 204 when coupled thereto. Further, the module couplers 306 may each have separate coupler receivers defined therein. The first coupler receiver 308 may be sized to receive a fastener that couples the module coupler 306 to the first section 202. A second coupler receiver 310 may be sized to receive a fastener that couples the module coupler 306 to the second section 204. Lastly, light module coupler receivers 312 may be sized to receive a fastener that couples the secondary module 212 to both the first section 202 and the second section 204.

The module couplers 306 may provide multiple coupler receivers 308, 310, 312 to allow the sections 202, 204 of the cover assembly 200 to be coupled to one another separately from the secondary modules 212. More specifically, the fasteners can be positioned in each of the first and second coupler receivers 308, 310 to couple the first and second sections 202, 204 to one another without the secondary modules 212 being coupled thereto. After the sections 202, 204 are coupled to one another via the coupler receivers 308, 310, the secondary modules 212 may be coupled thereto via the module coupler receivers 312. That is to say, the secondary modules 212 may be removed from the cover assembly 200 while the first and second sections 202, 204 remain coupled to one another with the module coupler 306.

Each secondary module 212 may be coupled to the cover assembly 200 with at least two module couplers 306. In one non-exclusive example, the secondary modules 212 may be positioned along a seam of the cover assembly 200 and be coupled thereto via module couplers 306 at an upper and lower position along the seam relative to a center of the secondary module 212. However, any number and location of module couplers 306 is considered herein, and the particular configuration described is just one example.

The first section 202 of the cover assembly 200 may at least partially cover a monitor controller 314. The monitor controller 314 may communicate with the motor assemblies 112, 116 to selectively reposition the outlet 102 among other things. The controller 314 may have a Controller Area Network ("CAN") connector 316 that is sized to couple to a CAN network of the firefighting device. In one non-exclusive example, the connector 316 allows the controller 314 to communicate with a user interface of the firefighting device to allow a user to input commands to the controller 314 among other things. Further, the primary module 210 may be positioned along the cover at location proximate to the monitor controller 314 wherein removing the primary module 210 provides access to the monitor controller 314.

Figure 4:
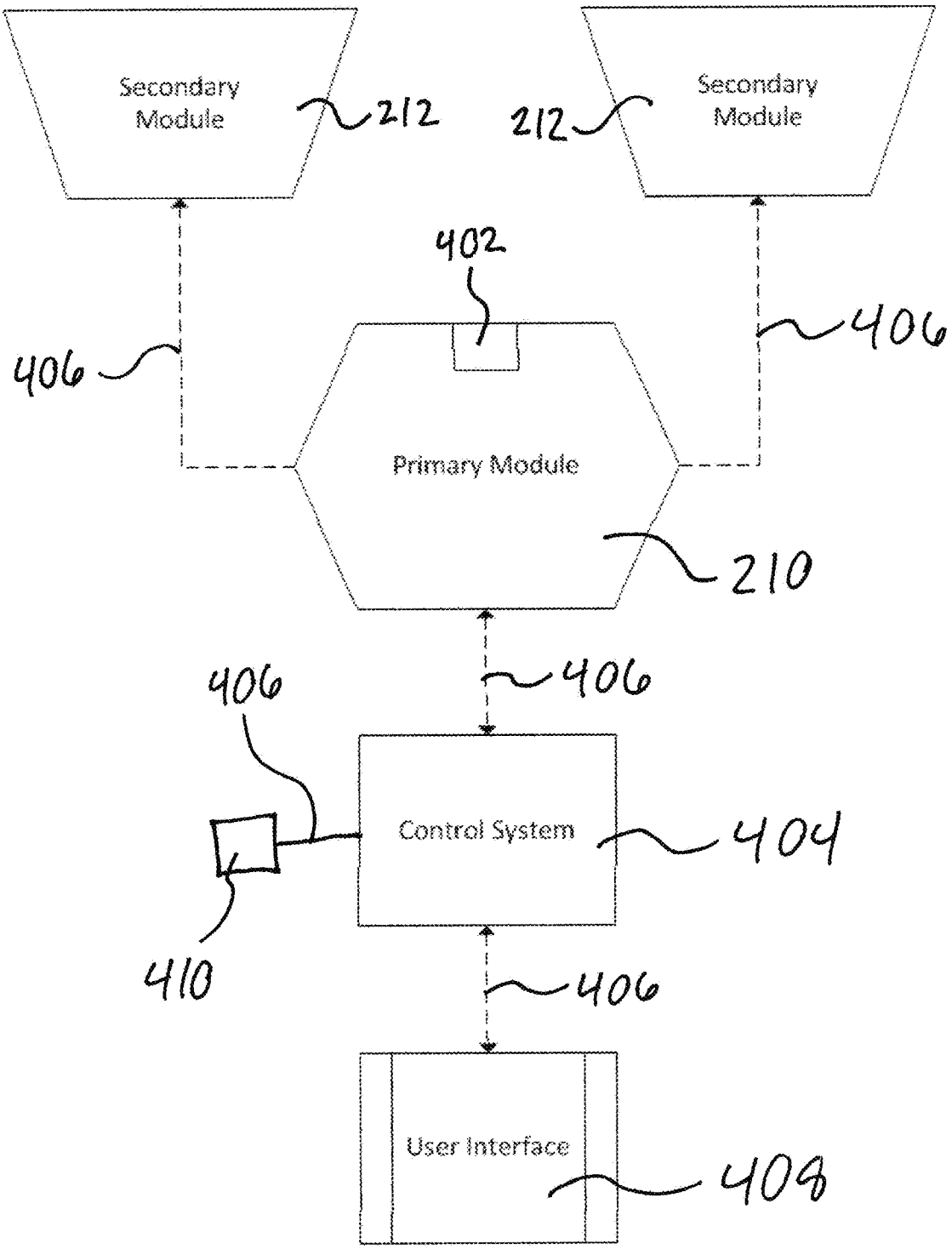
FIG. 4 is a schematic view of a system.

Referring now to FIG. 4, a schematic view 400 of a control system of the light assembly 208 is illustrated. In the embodiment of FIG. 4, the primary module 210 communicates with each secondary module 212 of the system. The primary module 210 may have a light controller 402. The light controller 402 may have a processor and a memory unit configured to execute and store commands. Further, the light controller may allow the primary module 210 to control the illumination properties of each of the primary module 210 and the secondary modules 212. The illumination properties may include light color, brightness, flashing pattern, and the like.

While a light controller 402 is illustrated and described herein as part of the primary module 210, other embodiments may position the light controller 402 in the secondary module 212. Further still, the light controller 402 may not be in any of the modules 210, 212 of the light assembly 208 at all but rather be part of another system of the firefighting device. Accordingly, positioning the light controller in the primary module 210 is only one exemplary embodiment of this disclosure and others are considered herein as well.

The light controller 402 may be in communication with a control system 404. In one non-exclusive example, the light controller and corresponding modules 210, 212 may utilize a CAN connection 406 to power and control the modules 210, 212. Alternatively, the light controller 402 may communicate wirelessly with the control system 404 to send and receive information regarding the light assembly 208. Any known wired or wireless communication protocol is considered herein and this disclosure contemplates utilizing any communication protocol known in the art.

The control system 404 may be a control system of a firefighting device 410 that controls other aspects of the firefighting device 410 as well. In one non-exclusive example, the light controller 402 may be coupled to the monitor controller 314 and a single CAN connection 406 may be coupled to the firefighting device 410 to control both the light assembly 208 and the monitor assembly 100. Further still, the control system 404 may be in communication with a user interface 408 to provide user inputs to the light controller 402. More specifically, the user interface 408 may be a touch-screen display, buttons, toggles, or any other known method for inputting information into a controller. The user interface 408 may communicate wirelessly with the control system 404 to provide user inputs. As one non-exclusive example, the user interface 408 may be a display on a wireless touch-screen device such as a smart phone or tablet.

The light assembly 208 may provide several selectable illumination properties for the corresponding modules 210, 212. In one example, the user interface 408 may allow a user to select the color or color pattern illuminated by the light source of one or more of the modules 210, 212. Alternatively, the user interface 408 may allow a user to select the brightness of one or more of the modules 210, 212. Further still, the user interface 408 may also allow a user to select a blinking pattern of one or more of the light modules 210, 212. In other words, the color, intensity, and blinking pattern of each module 210, 212 may be selectable by a user via the user interface 408.

In another aspect of this disclosure, the control system 404 may automatically alter the illumination properties of the light assembly 208 based on one or more condition of the firefighting device 410. For example, the firefighting device 410 may have a warning lighting system and the light assembly 208 may be selectably controlled to provide altered lighting patterns, colors, and brightness when the warning lighting system is engaged. Further still, the lighting assembly 208 may be altered by the control system 404 to aid in diagnostics of the control system 404. For example, the light assembly 208 may blink blue when a wireless data connection is secured or otherwise assist with diagnostics of the firefighting device 410.

The light assembly 208 can be utilized either automatically or via the user interface 408 to provide desired illumination properties. While several specific examples of scenarios for automatically altering the illumination properties are discussed herein, the light assembly 208 may be utilized to automatically respond to many other conditions of the firefighting device as well. This disclosure considers utilizing the light assembly 208 to provide automatic feedback to any situation that may be helpful to a user of the firefighting device 410 and the examples discussed herein are not exhaustive.

Figure 5:
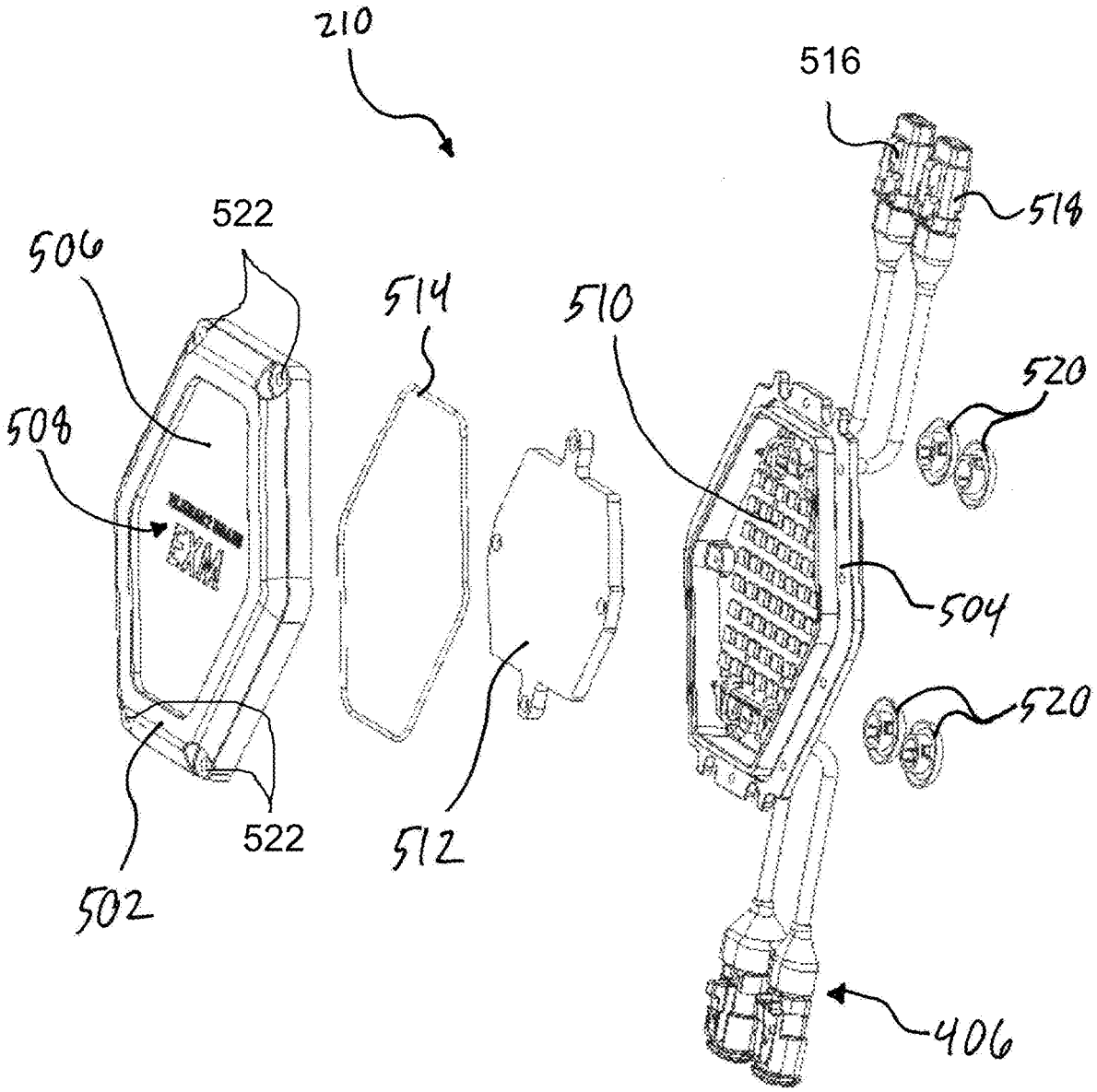
FIG. 5 is an expanded view of a primary module.

Referring now to FIG. 5, an expanded view of the primary module 210 is illustrated. In the expanded view, a bezel 502 is spaced from a housing 504. The bezel 502 is sized to receive a lens 506 therein to selectively couple the lens 506 to the housing 504. The lens 506 may have indicia 508 thereon that is selectively illuminated by a light source 510. The light source 510 may be positioned within the housing 504. Between the light source 510 and the lens 506 may be a diffuser 512. In one non-exclusive example the light source is an array of Light Emitting Diodes ("LEDs"). In this example, the diffuser 512 may diffuse the light provided by each LED of the array to provide a substantially consistent light distribution to the lens 506. In yet another embodiment of this disclosure, there is not a diffuser between the light source 510 and the lens 506.

The light source 510 may be any light source known in the art. While an LED array is discussed herein, other light sources are considered as well. Any lighting mechanism that provides selectable illumination properties is considered here, and the LED array is just one example.

The bezel 502 may be coupleable to the housing 504 via one or more fastener. Further, a seal 514 may be positioned between the lens 506 and the bezel 502 to substantially restrict moisture and other debris from entering an inner portion of the housing 504 wherein the light source 510 and diffuser 510 are located. Additional seals may also be positioned between the lens 506 and the housing 504, and between the bezel 502 and the housing 504, among other places, to ensure the inner portion of the housing 504 remains protected from moisture and other debris.

The housing may have access ports for a connection 406 to extend from the inner portion of the housing 504 to the control system 404 or other components. Further, connectors 516, 518 may extend from the inner portion of the housing 504 to each of the secondary modules 212. Each of the connectors 406, 516, 518 may exit the housing through a seal 520. The seals 520 may substantially prevent water and other debris from entering the inner portion of the housing 504.

In one aspect of this disclosure, fasteners of the primary module 210 extend through the housing 504 and into the bezel 502 to couple the bezel 502 and lens 506 to the housing 504 regardless of whether the housing 504 is coupled to the first section 202 of the cover assembly 200. Then, the entire primary module 210 may be selectably coupled to the first section 202 by four module fasteners positioned through assembly through holes 522, through corresponding openings on the housing 504, through adjacent through holes of the first section 202, and into a module coupler 306. In this configuration, the primary module 210 can be entirely removed from the first section 202 while the bezel 502, lens 506, seal 514, and housing 504 remain coupled to one another. However, other coupling configurations are also considered herein.

Figure 6:
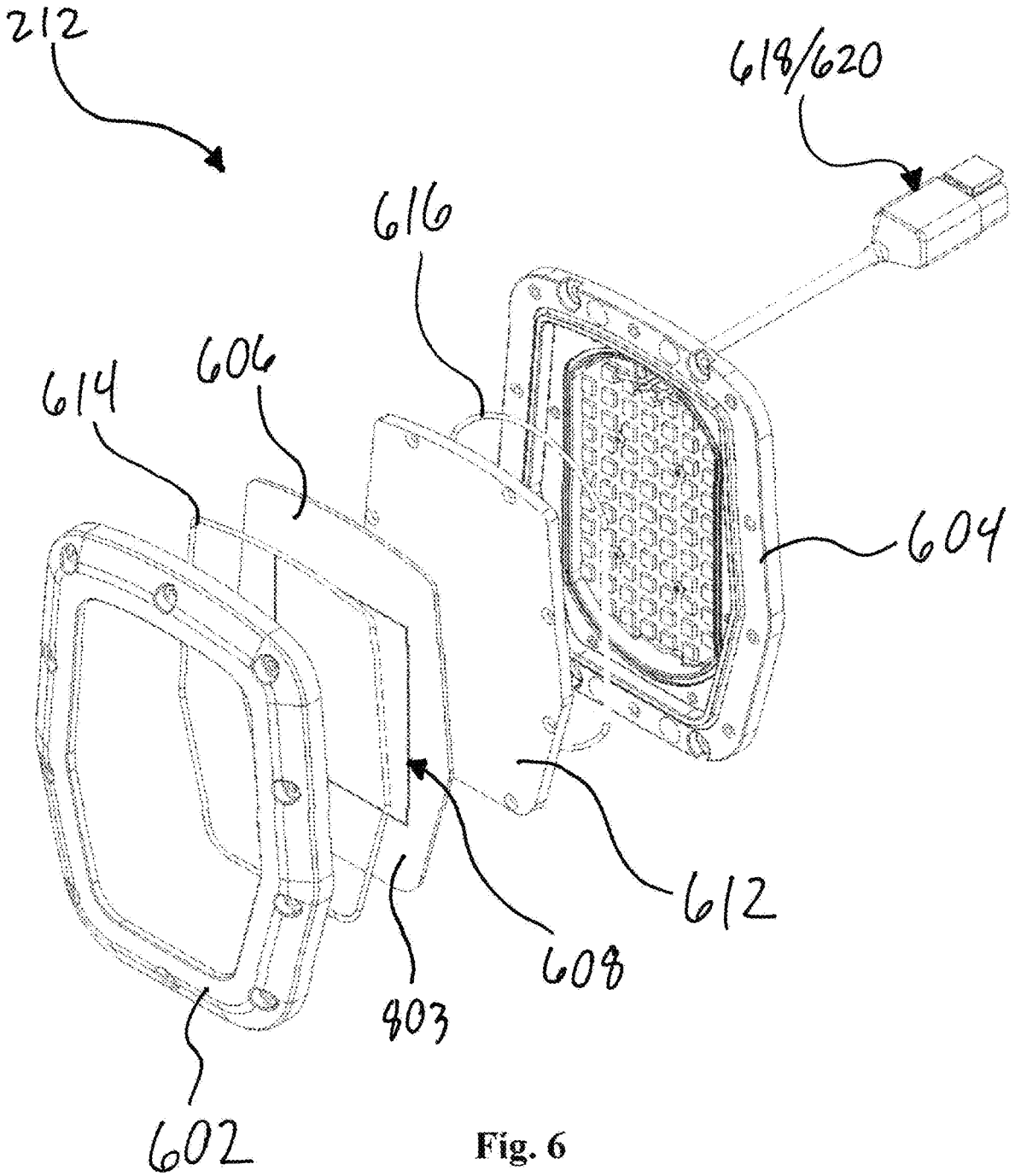
FIG. 6 is an expanded view of a secondary module.

Referring now to FIG. 6, an expanded view of the secondary module 212 is illustrated. In the expanded view, a bezel 602 is spaced from a housing 604. The bezel 602 is sized to receive a lens 606 therein to selectively couple the lens 606 to the housing 604. The lens 606 may have indicia 608 thereon that is selectively illuminated by a light source 610. The light source 610 may be positioned within the housing 604. Between the light source 610 and the lens 606 may be a diffuser 612. In one non-exclusive example the light source is an array of LEDs. In this example, the diffuser 612 may diffuse the light provided by each LED of the array to provide a substantially consistent light distribution to the lens 606.

The light source 610 may be any light source known in the art. While an LED array is discussed herein, other light sources are considered as well. Any lighting mechanism that provides selectable illumination properties is considered here, and the LED array is just one example.

In one aspect of this disclosure, the diffuser 612 may be coupled to the housing 604 to substantially seal the light source 610 therein to prevent water and debris from contacting the light source 610. In one non-exclusive example, a seal 616 may be positioned between the diffuser 612 and the housing 604 and the diffuser 612 may be coupled to the housing with fasteners. In this configuration, the light source 610 remains substantially protected from water and debris when the lens 606 and bezel 602 are not coupled thereto.

The bezel 602 may be coupleable to the housing 604 via one or more fastener. Further, a seal 614 may be positioned between the lens 606 and the bezel 602 to substantially restrict moisture and other debris from entering the space between the lens 606 and the diffuser 612. Further, additional seals may be positioned between the bezel 602 and the housing 604, among other places, to substantially prevent moisture and debris from distorting or otherwise affecting the secondary module 212.

Figure 7:
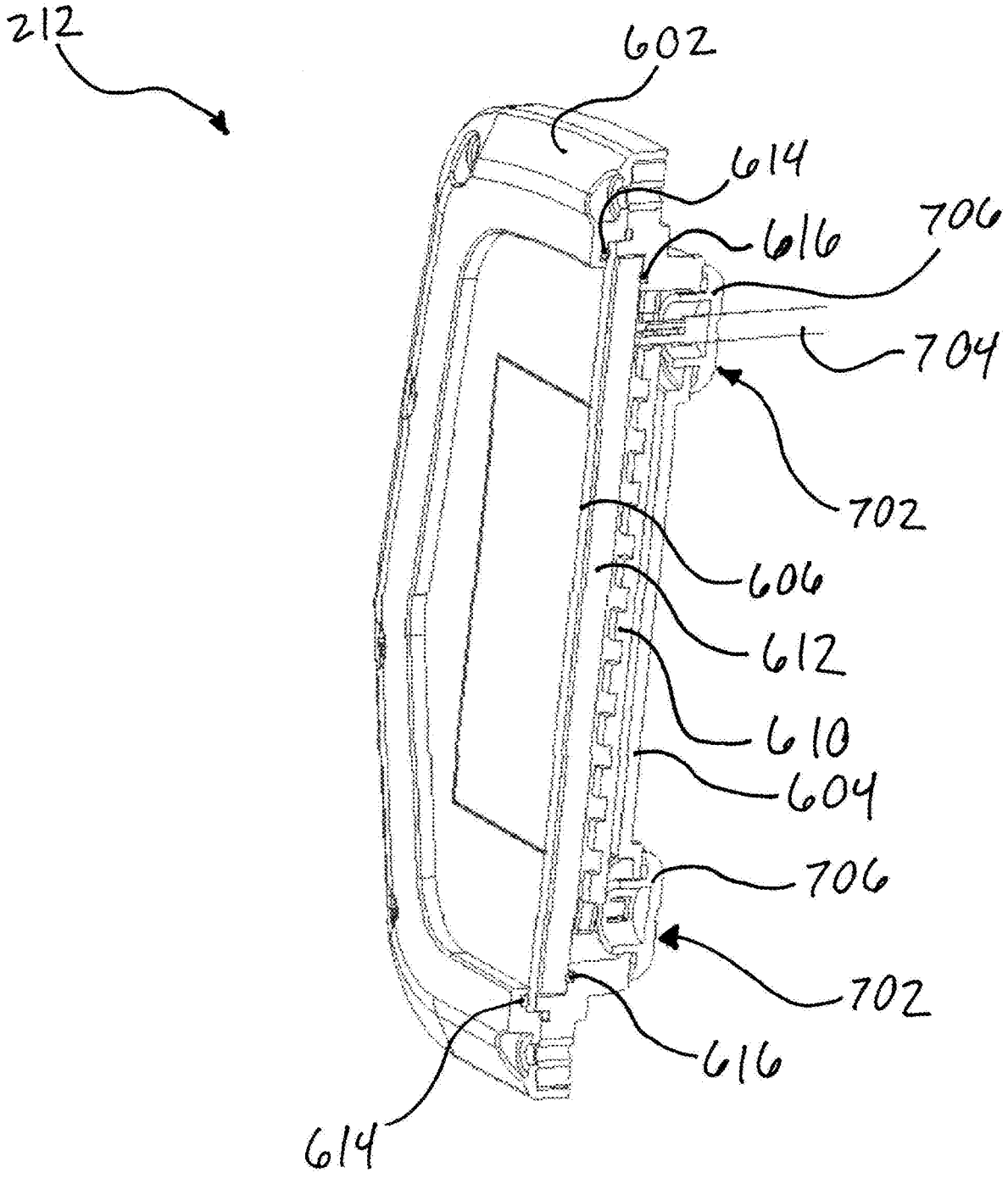
FIG. 7 is a section view of the secondary module of FIG. 6.

Referring now to FIG. 7, a section view of the secondary module 212 is illustrated. Along with showing the layered orientation of the lens 606, diffuser 612, light source 610, housing 604, and seals 616, 614, this section view also illustrates ports 702 defined through the housing 604. The ports 702 may be through holes defined in the housing 604 that provide a location for a line 704 for a connector 618, 620 (see FIG. 6) to extend there through. The ports 702 may have corresponding seals 706 therein to substantially seal the port 702 and protect the light source 610 from water and debris. The seals 706 may substantially block the corresponding ports 702 when no line 704 is passing there through. Alternatively, the seals 706 may allow the line 704 to pass there through will substantially sealing the remaining portions of the port 702.

In one aspect of this disclosure, the housing 604 and light source 610 are sized to fit together in substantially 180 degree offset orientations. In a first orientation, the light source 610 aligns the line 704 with the top port 702 from the perspective of FIG. 7. Alternatively, the light source 610 can be rotate 180 degrees so the line 704 exits the housing 604 at the bottom port 702 from the perspective of FIG. 7. In this configuration, the user can select how to assemble the light source 610 to the housing 604, selecting the orientation that provides the most advantageous routing of the line 704. More specifically, if the secondary module 212 is mounted on a first side of the cover assembly 200, it may be advantageous to route the line 704 through the top port 702. Alternatively, if the secondary module 212 is on a second opposite side of the cover assembly 200, it may be advantageous to route the line through the bottom port 702. Accordingly, the housing 604 and light source 610 disclosed herein provide can be reconfigured to provide advantageous routing of the line 704.

In one aspect of this disclosure, each secondary module 212 may have a single connector 618, 620 configured to couple to the corresponding connector 516, 518 of the primary module 210. As discussed herein, once the secondary module 212 is coupled to the primary module 210 via the corresponding connectors 516, 518, 618, 620, the primary module 210 may control the illumination properties of the secondary module 212.

Figure 8:
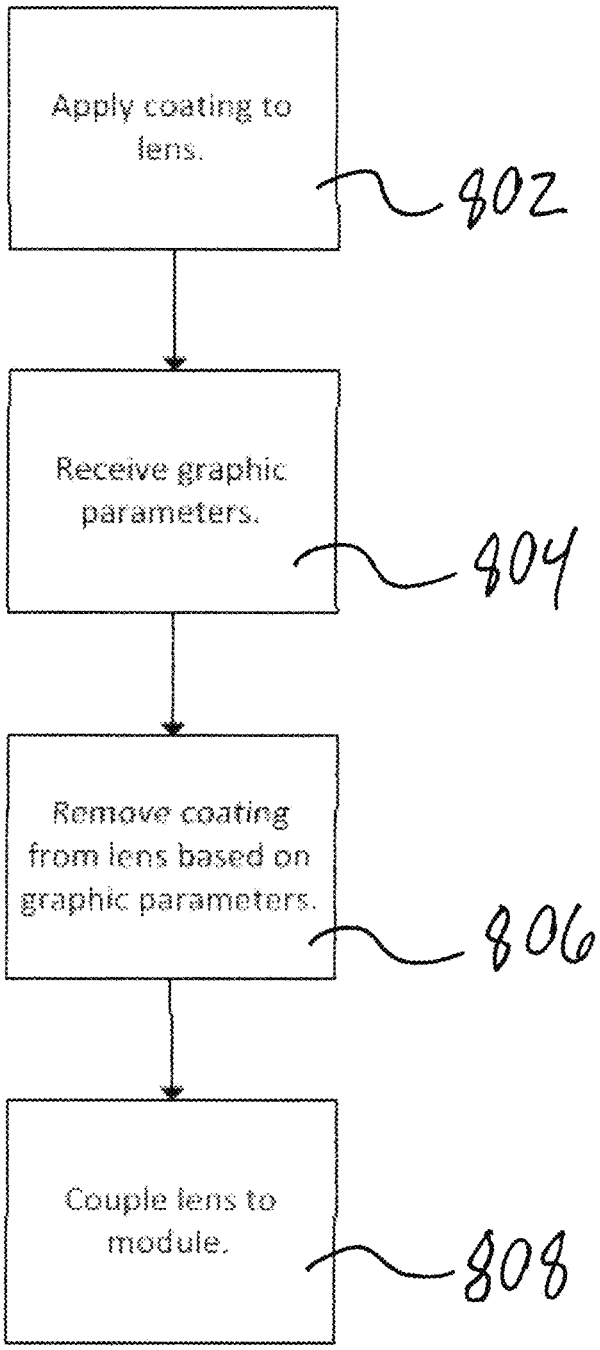
FIG. 8 is a method for creating indicia on a lens.
Figure 9:
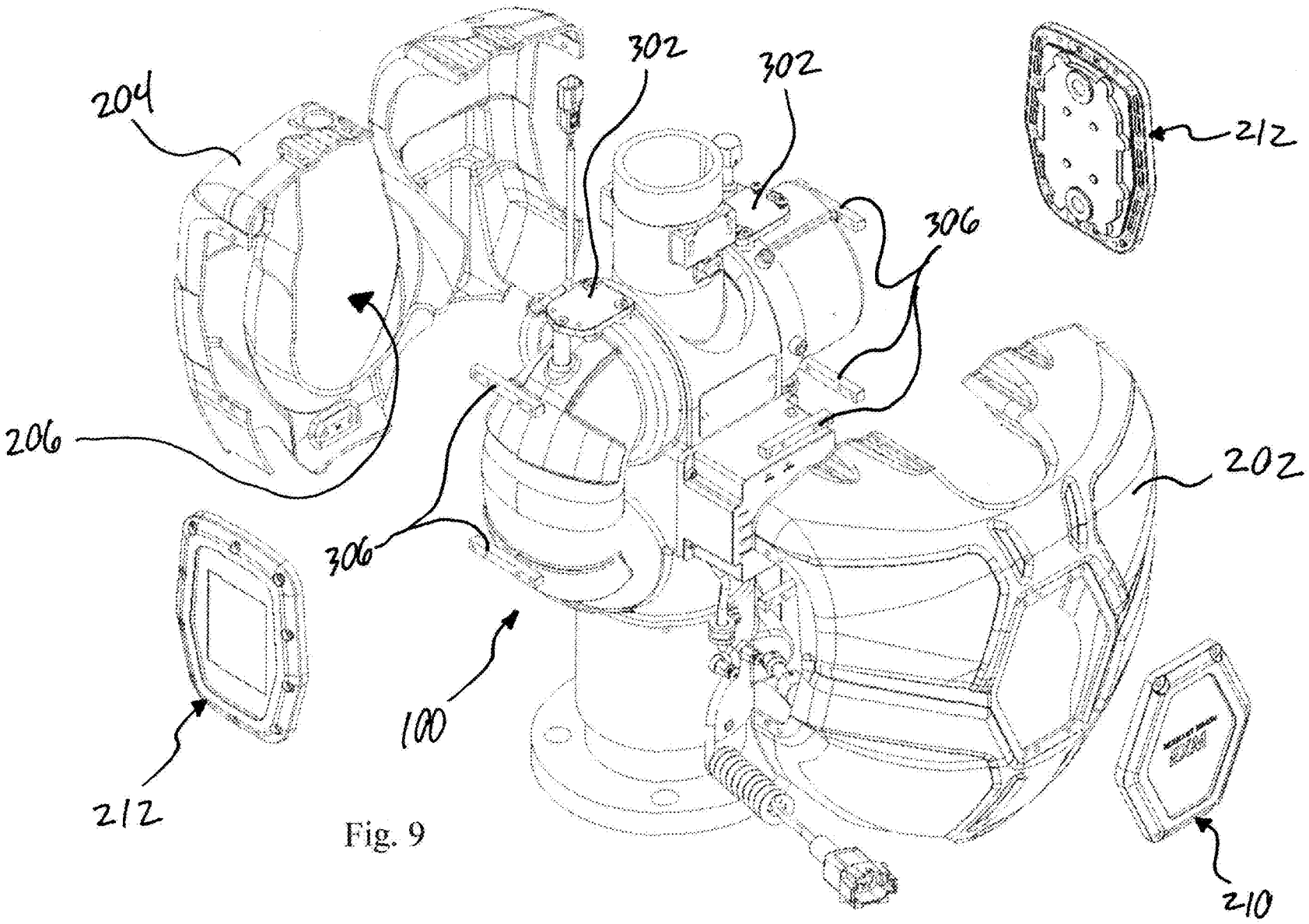
FIG. 9 is an expanded view of the monitor assembly of FIG. 2*a.*

In one aspect of this disclosure, the lenses 506, 606 may have indicia 508, 608 thereon. FIG. 8 illustrates one method for applying indicia 508, 608 to the lenses 506, 606 considered for this disclosure. More specifically, in a first box 802, a coating 803 is applied to the lens. The coating 803 may be painted onto the lens or otherwise applied to substantially cover one surface of the lens. The coating 803 may be any material that at least partially blocks or otherwise alters light as it is applied thereto. Box 804 identifies the parameters for the graphics to be applied to the lens as indicia. The graphics may be an emblem for a specific firehouse, a number representing a precinct, information regarding a specific fire company, or any other customizable information. Next, in box 806, the coating 803 is removed from the lens to illustrate the graphic parameters identified in box 804. In one non-exclusive example, the coating 803 may be removed via a laser etching process in a mirrored orientation. However, any process for removing the coating 803 is considered herein. Lastly, the lens is coupled to the corresponding module 210, 212 to illustrate the indicia when the light source is illuminated.

In an alternative embodiment, the lenses described herein may be formed of a solid material such as metal or plastic and block light from substantially shining through. In this embodiment, the indicia would be formed by cutouts through the entire lens wherein the adjacent light only passes through the lens at the cutout, thereby projecting the indicia formed through the cutout in the lens. Accordingly, instead of defining the indicia only through a coating in the lens, the indicia may be a cutout through the entire lens.

In yet another embodiment, the light assembly may have light modules that include a display screen such as an LCD display or the like instead of the light modules discussed herein having a lens and a light source. In this embodiment, the light modules may be capable of displaying user selectable graphics as indicia. More specifically, the indicia may be an icon or the like uploaded to one or more of the modules to be displayed on the display.

In one aspect of this disclosure, the cover assembly 200 is customizable to fit the needs and style preferences of the firefighters that will be using the firefighting device. More specifically, the color of the lights presented by the modules may be selectable to correspond with the colors of the particular firehouse of the firefighting device. Similarly, the lenses may easily be removed so that replacement lenses with different indicia can be coupled thereto. This allows the owner of the cover assembly 200 to select the specific indicia displayed when the module is illuminated. Further still, lenses may be manufactured with alternative indicia and sent to the firefighters to easily replace the lenses with updated indicia.

While the disclosure has been illustrated and described in detail in the drawings and foregoing description, such illustration and description is to be considered as exemplary and not restrictive in character, it being understood that illustrative embodiment(s) have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A firefighting device, comprising:

a monitor assembly having an outlet configured to selectively distribute a fluid there from, the outlet being pivotal about a first axis and a second axis;

a cover removably coupled to the monitor assembly and defining an opening; and a light assembly physically coupled to the cover;

wherein, the light assembly shows customizable indicia;

wherein, the outlet is positioned through the opening and movable within the opening in a range defined by the monitor assembly without substantially contacting the cover.

2. The device of claim 1, wherein the light assembly has a primary module coupled to the cover at a first location and a secondary module coupled to the cover at a second location, the second location being spaced from the first location.

3. The device of claim 1, further wherein the light assembly illuminates the indicia in one of a plurality of user-selectable color or illumination pattern.

4. The device of claim 1, further comprising a lens having a coating thereon and the indicia is formed on areas of the lens wherein the coating is removed.

5. The device of claim 1, further wherein the indicia is an identifier of a fire station.

6. The device of claim 1, further wherein the cover is formed of a first section and a second section coupled to the monitor.

7. The device of claim 1, wherein the cover assembly rotates with the monitor assembly about the first axis.

8. The device of claim 1, further wherein the light assembly is controllable through a Controller Area Network of the firefighting device.

9. The device of claim 2, further wherein the primary module controls the illumination properties of the secondary module.

10. The device of claim 4, further wherein the light assembly includes a diffuser positioned between the lens and a light source to evenly spread the light from the light source to the lens.

11. The device of claim 6, further wherein the light assembly has a secondary module coupled to both the first section and the second section.

12. The device of claim 7, further wherein the cover defines an opening wherein the outlet is pivotal about the second axis in a range defined by the monitor assembly without substantially contacting the cover.

13. The device of claim 8, further wherein the light assembly selectably indicates diagnostics of the firefighting device.

14. A cover for a monitor of a firefighting device, comprising:

a cover assembly removably coupled to the monitor, the cover assembly defining an opening; wherein an outlet of the monitor is within the opening without substantially contacting the cover assembly; wherein the outlet is pivotable about a first and second axis and a light assembly coupled to the cover assembly, the light assembly having a housing, a light source, a lens with indicia, and a bezel;

wherein the bezel and lens are removable from the housing while the housing remains coupled to the cover assembly.

15. The cover of claim 14, further wherein the lens has a coating thereon that substantially restricts light from passing thereby and the indicia is defined on the lens at portions where the coating is removed.

16. The cover of claim 14, further wherein the light assembly has a plurality of illumination properties that are selectably controlled by a control system of the firefighting device.

17. The cover of claim 16, further wherein the illumination properties are selectable by a user interface.

18. The cover of claim 17, further wherein the illumination properties include one or more of light intensity, light color, and lighting pattern produced by the light assembly.

19. A method for displaying indicia on a cover of a monitor assembly for a firefighting device that directs discharge of a fluid, comprising:

positioning an outlet of the monitor assembly through an opening of the cover, wherein the outlet is pivotable in the first and second axis, wherein the cover is removably coupled to the monitor;

coupling a housing of a light assembly to the cover, the housing containing a light array;

etching indicia into a coating from a lens to allow light produced by the light array to display the indicia;

aligning the lens with the housing; and coupling a bezel to the cover to position the lens at least partially between the bezel and the housing wherein, the outlet is movable within the opening in a range defined by the monitor assembly without substantially contacting the cover.

20. The method of claim 19, further comprising positioning a diffuser between the light array and the lens wherein the diffuser substantially seals the light array within the housing.

* * * * *